US008628374B2

(12) United States Patent
McDonald

(10) Patent No.: US 8,628,374 B2
(45) Date of Patent: Jan. 14, 2014

(54) EXPANDABLE TOY BUILDING ELEMENT

(75) Inventor: David Lewis McDonald, Ontario (CA)

(73) Assignee: Spin Master Ltd., Toronto, Ontario (CA)

( * ) Notice: Subject to any disclaimer, the term of this patent is extended or adjusted under 35 U.S.C. 154(b) by 78 days.

(21) Appl. No.: 13/303,399

(22) Filed: Nov. 23, 2011

(65) Prior Publication Data

US 2013/0084767 A1 Apr. 4, 2013

(30) Foreign Application Priority Data

Sep. 29, 2011 (CA) ..... 2753957

(51) Int. Cl.
*A63H 33/08* (2006.01)

(52) U.S. Cl.
USPC ..... 446/128; 52/596

(58) Field of Classification Search
USPC ..... 52/596, 604, 831; 446/128
See application file for complete search history.

(56) References Cited

U.S. PATENT DOCUMENTS

| | | | | | |
|---|---|---|---|---|---|
| 2,233,901 | A | * | 3/1941 | Scacchetti | 52/292 |
| 3,220,141 | A | * | 11/1965 | Goss, III | 446/124 |
| 3,242,610 | A | * | 3/1966 | Christiansen | 446/128 |
| 4,606,732 | A | * | 8/1986 | Lyman | 446/120 |
| D290,627 | S | * | 6/1987 | Dideriksen | D21/486 |
| 5,938,498 | A | * | 8/1999 | Glynn | 446/124 |

* cited by examiner

*Primary Examiner* — John Ricci
(74) *Attorney, Agent, or Firm* — Cozen O'Connor

(57) ABSTRACT

An expandable toy building element being interconnectable with one or more other toy building elements is disclosed having one or more coupling connectors adapted to interconnect the expandable toy building element with another toy building element. The expandable toy building element has a hollow first end component with an open, distal end so as to define a first internal cavity, a hollow second end component with an open, distal end so as to define a second internal cavity; and a translation element acting to expandably connect the first end component to the second end component. The expandable toy building element is expandable between a compact position and at least one expanded position.

7 Claims, 4 Drawing Sheets

EXPANDABLE TOY BUILDING ELEMENT

FIELD OF THE INVENTION

The present invention relates generally to toy blocks, and more specifically, to an expandable, interconnectable toy building element.

BACKGROUND OF THE INVENTION

Toy building blocks exist in a wide variety of shapes and sizes and are popular children's toys. However, available toy building blocks are not expandable from a first size to a second size in order to increase the variety of construction options during play.

Further, non-expandable interconnectable toy blocks, such as LEGO® or DUPLO® blocks, usually come in the form of basic geometric shapes such as a cube or rectangular parallelepiped, disc or plate, polyhedron, and the like. They can be connected together by inserting one or more studs of a toy block into corresponding mating recesses of another toy block. Simple or complex play structures such as those that resemble the shape of a building, a train, and the like can be formed depending on the way these toy blocks are connected together. However, these toy blocks are not themselves physically expandable from a first size to a second size.

Accordingly, there is need for an interconnectable toy building element that is expandable from a first size to a second size.

SUMMARY OF THE INVENTION

In one aspect, the present invention provides an expandable toy building element which is interconnectable with one or more other toy building elements. The expandable toy building element has one or more coupling connectors with which the expandable toy building element can interconnect with the one or more other toy building elements. The expandable toy building element also has a first end component and a second end component, both of which are hollow and have an open end so as to define a first and a second internal cavity. A translation element expandably connects the first end component to the second end component, such that the expandable toy building element is expandable between a compact position and at least one expanded position. When the expandable toy building element is in the compact position, the open end of the first end component abuts the open end of the second end component such that the translation element is completely enclosed within the first internal cavity and the second internal cavity. When the expandable toy building element is in the at least one expanded position, the open end of the first end component is separated from the open end of the second end component, so as to at least partially expose the translation element from each of the first internal cavity and second internal cavity. The expandable toy building element is interconnectable with the one or more other toy building elements when the expandable toy building element is in at least one of the compact position and the expanded position.

Another aspect of the present invention provides a kit containing a plurality of interconnectable toy building elements, including at least one expandable toy building element as described herein.

BRIEF DESCRIPTION OF THE DRAWINGS

Preferred embodiments will now be described in greater detail and will be better understood when read in conjunction with the following drawings.

DETAILED DESCRIPTION OF THE INVENTION

Figure 1:
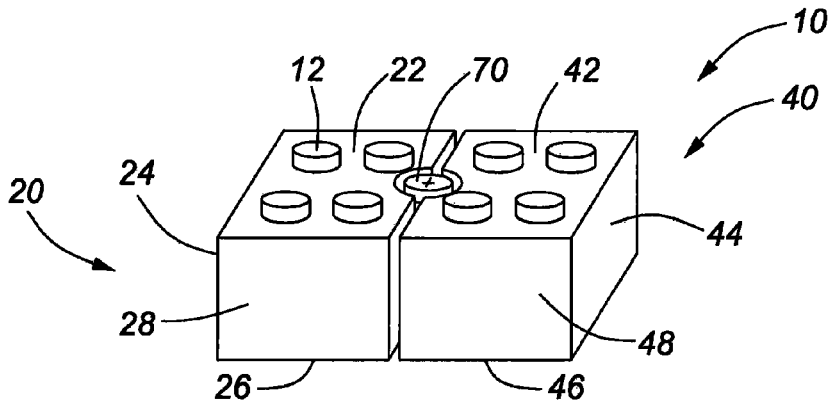
FIG. 1 is a top perspective view of an expandable toy building element in a compact position in accordance with at least one embodiment.

As used herein, the terms "upper", "lower", "top", "bottom", "upward", "downward", "proximal", "distal", and the like are intended to indicate relative directions or positions solely in the context of the present expandable toy building element, independently of the orientation of the expandable toy building element with respect to the earth's surface or any other external reference.

An expandable, interconnectable toy building element is provided wherein the element can be expanded from a compact position to at least one expanded position. The expandable toy building element can be any colour and any size that is suitable for the intended application.

The expandable toy building element can take any suitable shape, including but not limited to a prismatic shape, pyramidal shape, parallelepiped shape, cylindrical shape or other suitable shapes as required by the intended application.

The expandable toy building element and all elements discussed herein may be formed of any material that is suitable for the application including, but not limited to, plastics such as acrylonitrile butadiene styrene (ABS) and polyvinyl chloride (PVC), wood, metal, rubber, silicone, and composite materials, among other materials that will be readily apparent to the skilled person. The expandable toy building element and related components may be formed by any suitable manufacturing process including but not limited to injection molding, among other manufacturing processes that are known to the skilled person.

As discussed above, the expandable toy building element has a first end component that can be linearly translated relative to a second end component. The end components of the expandable toy building element may each be a single, monolithic component, or may each be formed from multiple components suitably connected together. In at least one embodiment, each end component has an internal cavity that is adapted to receive a translation component. Further, each end component has a proximal end that is closed and a distal end having an opening for providing access to the internal cavity.

In this way, when the distal ends of each of the end components abut one another such that the expandable toy building element is in a compact position, the two openings also abut one another and a translation component is completely housed within the expandable toy building element. When the two end components are translated relative to one another such that the expandable toy building element is in an expanded position, the translation component partially projects from each cavity while the first end component remains linked to the second end component in the expanded position by way of the translation component.

The first end component of the expandable toy building element is linked to the second end component of the expandable toy building element by way of a translation component, as discussed above. The translation component is adapted such that the first end component of the building block can be moved relative to the second end component of the building block from a first position to a second position. In this way, the building block can be expanded from a compact, first size to at least one extended, second size. The translation component can take a variety of forms depending on the needs of the intended application, as will be discussed in further detail below.

In at least one embodiment the expandable toy building element may be adapted such that it can interconnect with other, similarly adapted building elements. Suitable interconnecting brick systems, such as those marketed under the trade-marks Lego® and Duplo® for example, are well known. The expandable toy building element has one or more coupling connectors adapted to connect the expandable toy building element to another building element. In at least one embodiment the one or more coupling connectors are at least one stud and at least one recess.

In some embodiments, the stud and recess are sized such that the stud is frictionally yet releasably gripped in the recess. Embodiments are also contemplated wherein the stud of the expandable toy building element is adapted to interconnect with a recess on a different toy building element that is sized differently than the recess provided on the bottom surface of the expandable toy building element. In at least one embodiment the stud is cylindrical, however other stud shapes such as but not limited to polygonal, triangular and prismatic, are also contemplated.

In at least one embodiment the recess is defined by a space provided between a downwardly projecting perimeter wall and at least one downwardly projecting tube, however other recess shapes are also contemplated, such as cylindrical sockets or polygonal sockets, among other recess shapes that will be readily recognized by the skilled person.

With reference to FIG. 1, at least one embodiment of expandable toy building element 10 is illustrated wherein expandable toy building element 10 is in a compact position. Expandable toy building element 10 has a first end component 20 and a second end component 40. As discussed above, both first end component 20 and second end component 40 may have stud-bearing walls 22, 42, end walls 24, 44, recess-bearing walls 26, 46, first side walls 28, 48 and second side walls (not shown) as can further be seen in FIGS. 2, 3 and 4. Stud-bearing walls 22, 42 may include upwardly projecting studs 12.

Figure 2:
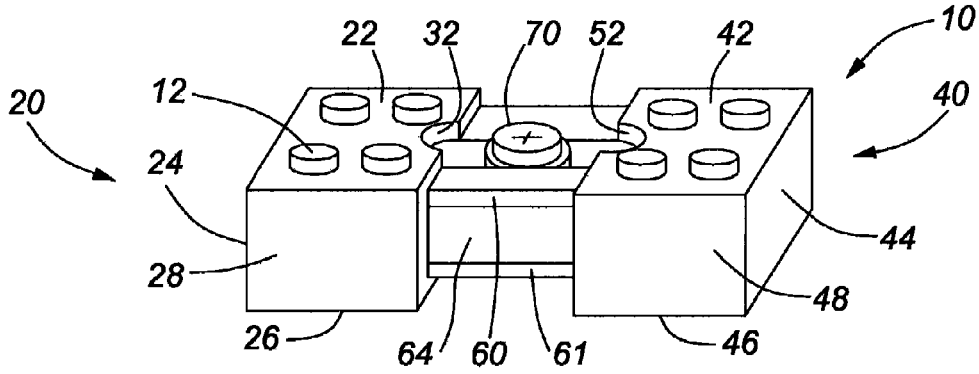
FIG. 2 is a top perspective view of an expandable toy building element in an expanded position in accordance with the embodiment of FIG. 1.
Figure 4:
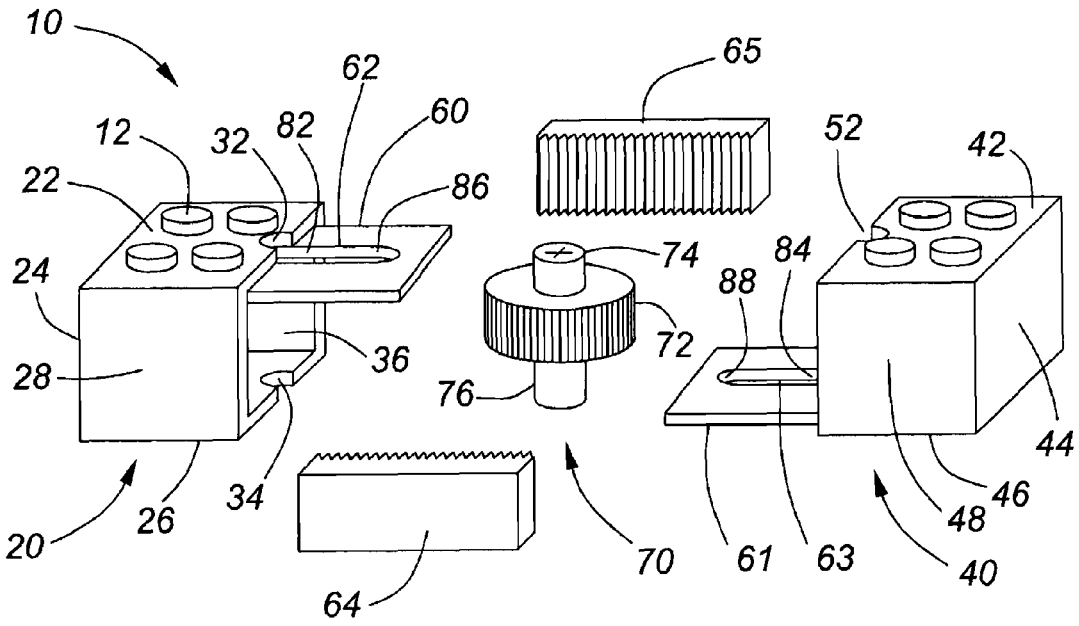
FIG. 4 is an exploded perspective view of an expandable toy building element in an expanded position in accordance with the embodiment of FIG. 1.

With reference to FIG. 2, at least one embodiment of expandable toy building element 10 is illustrated in an expanded position, where first end component 20 has been linearly translated relative to second end component 40, the function of which will be discussed in further detail below. Stud-bearing walls 22, 42, recess-bearing walls 26, 46, first side walls 28, 48 and second side walls (not shown) have distal edges which define an opening for an internal cavity (such as internal cavity 36, as can be seen in FIG. 4). The internal cavity provides a space wherein a translation component can be mounted.

When expandable toy building element 10 is in the compact position, as seen in FIG. 1, the translation component is housed completely within the internal cavity provided in each of first end component 20 and second end component 40. When expandable toy building element 10 is in the expanded position, the translation component partially protrudes from each internal cavity while staying linked to each end component, as seen in FIG. 2.

With reference to FIG. 4, an exploded view of expandable toy building element 10 is illustrated. In this embodiment, first end component 20 has a stud-bearing wall 22, a recess-bearing wall 26, end wall 24, first side wall 28 and second side wall (not shown). Likewise, second end component 40 has a stud-bearing wall 42 and a recess-bearing wall 46, end wall 44, first side wall 48 and second side wall (not shown). The end wall 24, first side wall 28 and second side wall (not shown) for first component 20 define a perimeter wall that, together with the stud-bearing wall 22 and the recess-bearing wall 26, enclose an internal cavity 36. As will be understood by the skilled person, second end component 40 also has an analogous internal cavity that is not shown in FIG. 4.

It is contemplated that the end components can be of unitary construction or may be formed by joining two or more components together by any suitable manner known to the skilled person. For example, a stud-bearing component can be joined to a recess-bearing component to form an end component. Stud-bearing walls 22, 42 may include projecting studs 12.

Figure 3:
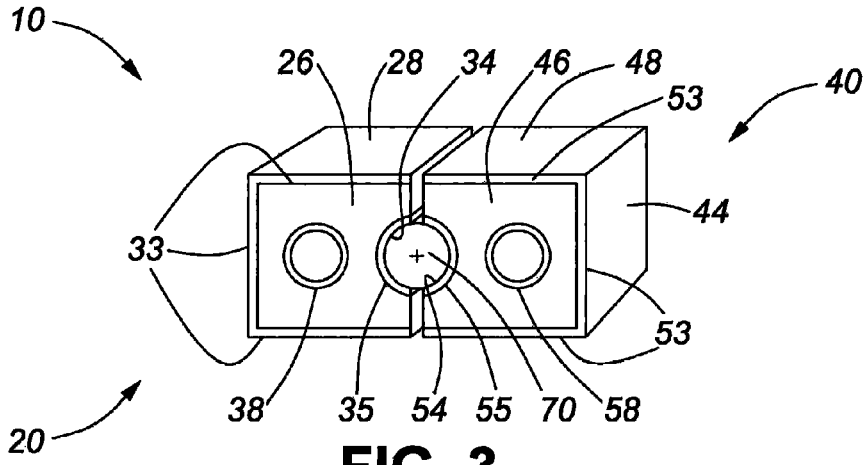
FIG. 3 is a bottom perspective view of an expandable toy building element in a compact position in accordance with the embodiment of FIG. 1.

As seen in FIG. 3, in at least one embodiment, recess-bearing walls 26, 46 can include a downwardly projecting perimeter wall 33, 53. In at least one embodiment, perimeter wall 33, 53 will extend downwardly the same distance that cylindrical stud 12 extends upwardly. Recess-bearing wall 26, 46 may also include a downwardly projecting tube 38, 58. Tube 38, 58 projects downwardly from the bottom surface and may be formed as an annular ring or a monolithic cylinder. In embodiments where tube 38, 58 is an annular ring, the interior diameter of the annular ring may be sized such that a cylindrical stud 12 may be forcibly gripped within the annular ring.

In at least one embodiment tube 38, 58 is centrally located, as seen in FIG. 3, such that a recess is provided that can forcibly grip an appropriately sized cylindrical stud 12. In at least one embodiment, the recess is defined by the space between the perimeter wall 33, 53, the outer surface of tube 38, 58 and the lip 35, 55. As illustrated in FIG. 3, a circular element, such as the cylindrical stud described above, can be gripped between these elements in a frictional yet releasable manner, as will be readily understood by the skilled person.

As seen in FIGS. 1 to 4, in at least one embodiment, stud-bearing walls 22, 42 may have semicircular openings 32, 52. In at least one embodiment recess-bearing walls 26, 46 may have semicircular openings 34, 54, as seen in FIGS. 3 and 4.

Turning back to FIG. 4, in at least one embodiment first end component 20 and second end component 40 each have a projecting plate. One projecting plate may be oriented as an upper projecting plate 60 and one projecting plate may be oriented as a lower projecting plate 61. Upper projecting plate 60 may be connected to first end component 20 or second end component 40, however lower projecting plate 61 will be connected to the second end component 40 when upper projecting plate 60 is connected to first end component 20 and vice versa. The projecting plates may be integrally formed with the end components of the expandable toy building element or alternatively may be manufactured as a separate component and attached to the end components of the expandable toy building element by any suitable manner that will readily be apparent to the skilled person in the art.

In at least one embodiment, each of upper projecting plate 60 and lower projecting plate 61 may have a receiving slot 62, 63. Receiving slot 62, 63 can take a variety of suitable shapes and in at least one embodiment is obround. Each receiving slot has a proximal end 82, 84 and a distal end 86, 88 comparable to the distal and proximal ends of the end components of the expandable toy building element, as discussed above. The function of receiving slots 62, 63 will be discussed in further detail below.

In at least one embodiment, first end component 20 and second end component 40 are joined by a translation component. In at least one embodiment, the translation component is a dual rack and pinion system. As seen in FIG. 4, in at least one embodiment, first end component 20 has a first rack 64 connected to an interior surface of first end component 20 inside first interior cavity 36 and second end component 40 has a second rack 65 connected to the opposite interior surface of second end component 40 inside the second interior cavity (not shown). Each of the racks is oriented with an inwardly projecting set of teeth and an outer flat surface. The function of first rack 64 and second rack 65 will be discussed in further detail below.

With reference to FIG. 4, a rotating element 70 is illustrated. In at least one embodiment, rotating element 70 has a central portion that is a pinion gear 72 adapted to rotatably communicate with first rack 64 and second rack 65. Rotating element 70 may also have a first cylindrical portion 74 adapted to be rotatably received in upper receiving slot 62 and a second cylindrical portion 76 adapted to be rotatably received in lower receiving slot 63. When the expandable toy building element 10 is in the compact position, first cylindrical portion 74 can be received in semicircular openings 32, 52 and second cylindrical portion 76 can be received in semicircular openings 34, 54, as seen in FIGS. 1 and 3.

Figure 5A:
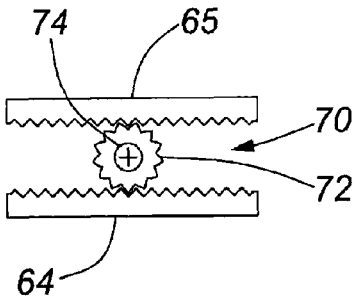
FIG. 5A is an top plan view of the rotating element engaging the first rack and second rack in a compact position in accordance with the embodiment of FIG. 1.
Figure 5B:
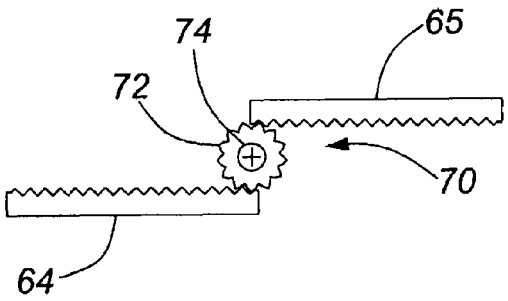
FIG. 5B is an top plan view of the rotating element engaging the first rack and second rack in a expanded position in accordance with the embodiment of FIG. 1.

With reference to FIGS. 5A and 5B, as the expandable toy building element 10 is moved from the compact position to the expanded position, rotating element 70 rotatably engages both first rack 64 and second rack 65. In the compact position first rack 64 is positioned directly opposing second rack 65 as illustrated in FIG. 5A. In the at least one expanded position the first rack 64 is translated linearly relative to the second rack 65 as illustrated in FIG. 5B. In this way, the first end component 20 (which is attached to one of first rack 64 or second rack 65) can be linearly translated relative to second end component 40 (which is attached to the other of the first rack 64 and second rack 65) as will be readily understood by the skilled person.

With reference to FIG. 4, in the compact position, first cylindrical portion 74 of rotating element 70 may abut the proximal end 82 of upper receiving slot 62 and second cylindrical component 76 of rotating element 70 may abut the proximal end 84 of lower receiving slot 63. In the at least one expanded position, first cylindrical portion 74 of rotating element 70 approaches, and can abut, the distal end 86 of upper receiving slot 62 and second cylindrical component 76 of rotating element 70 approaches, and can abut, the distal end 88 of lower receiving slot 63.

In at least one embodiment, the translation component can be a cam that has a first cam end pivotally linked to the first end component of the building block and a second cam end pivotally linked to the second end component of the building block.

Figure 6A:
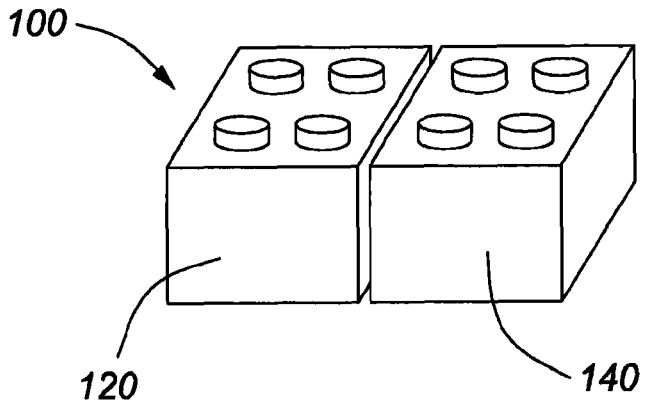
FIG. 6A is a perspective view of an expandable toy building element in accordance with another embodiment where the expandable toy building element is in a compact position.
Figure 6B:
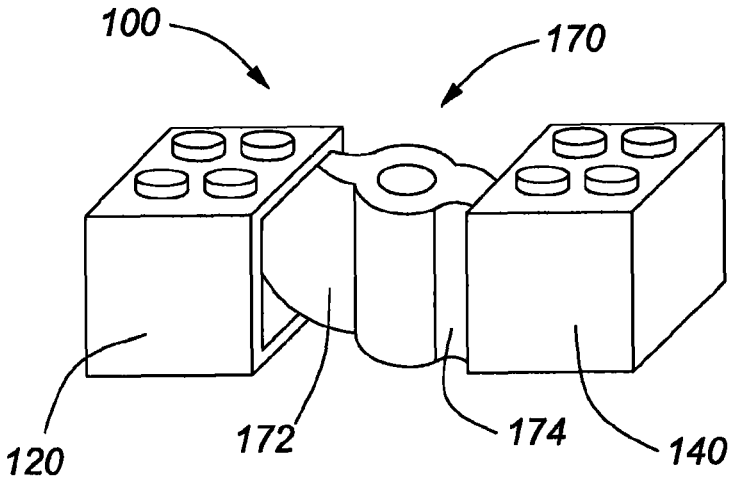
FIG. 6B is a perspective view of a expandable toy building element in accordance with the embodiment of FIG. 6A where the expandable toy building element is in an expanded position.
Figure 6C:
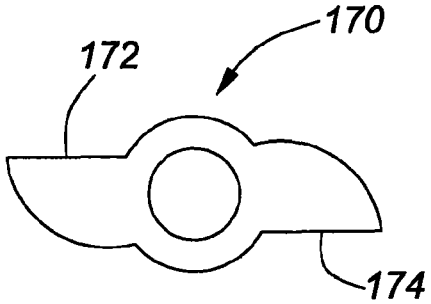
FIG. 6C is a top plan view of a cam of a expandable toy building element in accordance with the embodiment illustrated in FIGS. 6A and 6B.

With reference to FIGS. 6A, 6B and 6C at least one embodiment of a expandable toy building element is illustrated where the translation component is a cam. In this embodiment, expandable toy building element 100 has a first end component 120 and a second end component 140 that are analogous to first end component 20 and second end component 40 discussed above. First end component 120 is linked to the second end component 140 by way of a translation element that is a cam 170. As seen in FIG. 6C, cam 170 has a first cam end 172 and a second cam end 174. First cam end 172 is pivotally linked to the interior of the first end component 120 and the second cam end 174 is pivotally linked to the interior of the second end component 140.

In this way, cam 170 is sized such that it can pivotally retract into the interior cavity of first end component 120 and the interior cavity of second end component 140 when first end component 120 abuts second end component 140 in a compact position as seen in FIG. 6A. When first end component 120 is moved relative to second end component 140, first cam end 172 pivots within first end component 120 and second cam end 174 pivots within second end component 140 such that expandable toy building element 100 is expanded to reach an expanded position as seen in FIG. 6B.

Figure 7A:
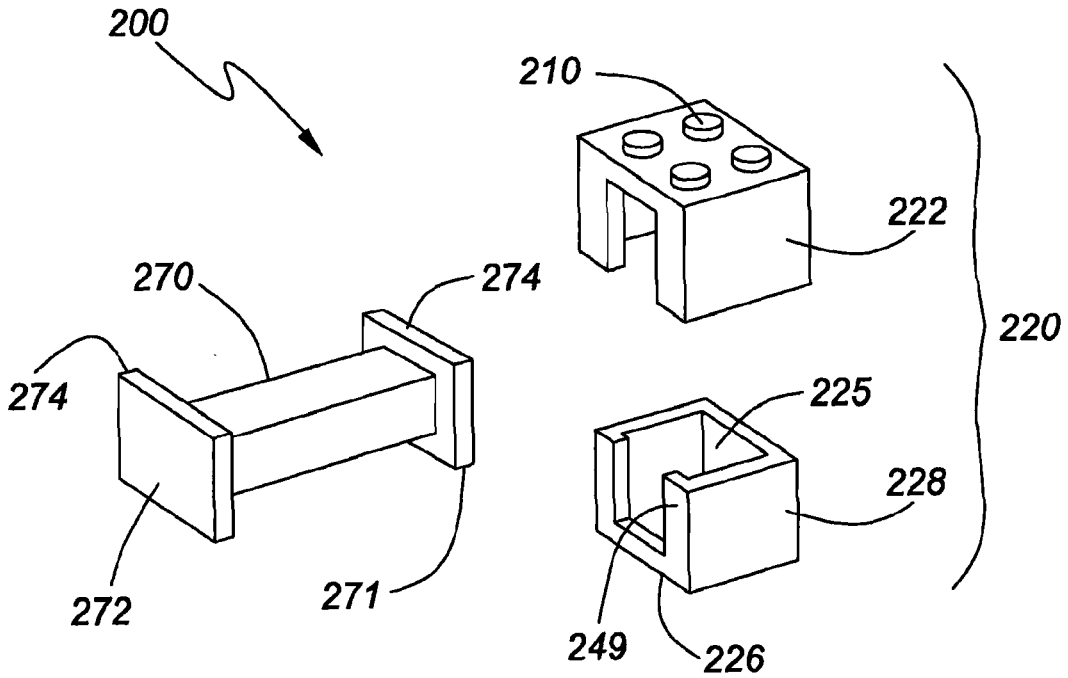
FIG. 7A is a partial exploded perspective view of an expandable toy building element in accordance with another embodiment.
Figure 7B:
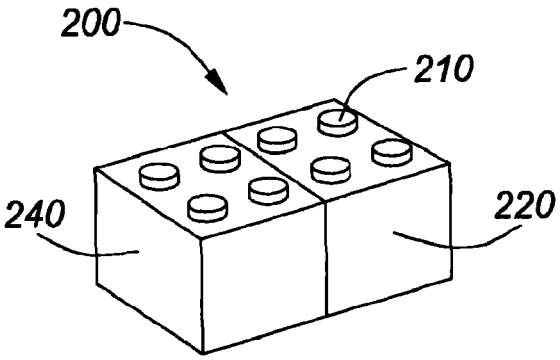
FIG. 7B is a perspective view of the embodiment of FIG. 7A in a compact position.
Figure 7C:
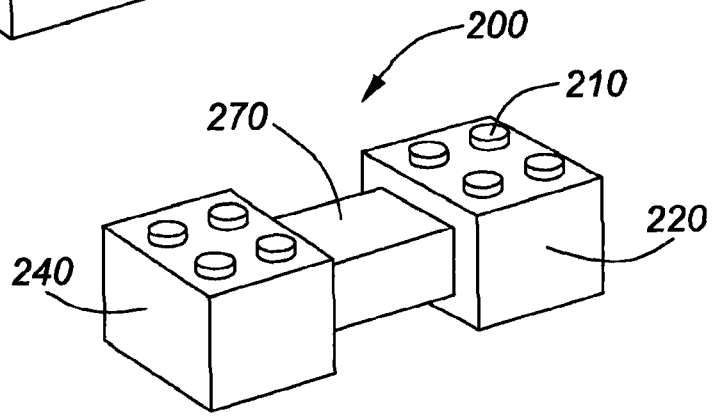
FIG. 7C is a perspective view of the embodiment of FIGS. 7A and 7B in an expanded position.

Turning to FIGS. 7A, 7B and 7C, another embodiment of an expandable toy building element is illustrated wherein the translation component is a flanged slide. As seen in FIGS. 7B and 7C, expandable toy building element 200 has a first end component 220 and a second end component 240. In at least one embodiment, first end component 220 has an outer shell component 222 and an inner liner component 228 defining a first internal cavity 225. Inner liner component 228 has a recess-bearing wall 226 that is analogous to recess-bearing walls 26, 46 described above. The skilled person will appreciate that second end component 240 has a corresponding outer shell component and inner liner component, defining a second internal cavity and having a recess-bearing-wall (not shown).

As will be understood by the skilled person, in at least one embodiment, outer shell component 222 is sized such that it slidably fits over inner liner component 228. Outer shell component 222 can be fixedly attached to inner liner component 228 by any number of ways known to the skilled person. For example, outer shell component 222 can be attached to inner liner component 228 by way of glue or a cooperating detent/recess system, among other arrangements that will be readily apparent to the skilled person.

In at least one alternative embodiment, end components 220 and 240 can be of unitary construction or can be formed by joining two or more components together by any suitable manner known to the skilled person, as described for end components 20, 120, 40, 140 above. First end component 220 and second end component 240 are otherwise analogous to first end component 20, 120 and second end component 40, 140 as discussed above. For example, both end components can include at least one upwardly extending cylindrical stud 210 and a recess-bearing wall such as recess-bearing wall 226.

As will understood by the skilled person, in at least one embodiment, the outer shell components may be manufactured of a material that is sufficiently flexible to allow the outer walls of the outer shell components to slightly bow as a detent engages the outer walls of the inner liner component during assembly.

As discussed above, in this embodiment, the translation component is a flanged slide 270, as seen in FIG. 7A. Flanged slide 270 has a first end 271 and a second end 272. Each end of flanged slide 270 has a perimeter flange 274. In at least one embodiment, flanged beam 270 is a rectangular prismatic shape, however other shapes that can slide freely within first internal cavity 225 and its counterpart second internal cavity in end component 240 are contemplated as well.

As seen in FIG. 7A, inner liner component 228 has a retaining flange 249. End component 240 has a corresponding retaining flange (not shown). Retaining flange 249 and its counterpart retaining flange in end component 240 act to retain perimeter flanges 274 within first internal cavity 225 and its counterpart second internal cavity in end component 240, when expandable toy building element 200 is in the at least one expanded position. The skilled person will recognize that in other embodiments, the retaining flange can be located on outer component 222 or around the opening at the distal end of end components 220, 240 of unitary construction. As will be apparent to the skilled person, the retaining flange 249 can be positioned on two opposing sides, or on three or four sides, of the opening at the distal end of each of the end components 220, 240, as long as the retaining flange acts effectively to retain the perimeter flanges 274 within the corresponding internal cavities.

When assembled, as seen in FIGS. 7B and 7C, building element 200 can be expanded from a first, compact position to a second, expanded position by linearly translating the first end component relative to the second end component. In this way, when building element 200 is in the at least one expanded position, perimeter flanges 274 engage the retaining flange 249 of end component 220, and the corresponding retaining flange of end component 240, such that the ends 271, 272 of the flanged beam 270 are retained within the internal cavities, such as first internal cavity 225, of the respective end components 220, 240.

In this way, an expandable toy building element is provided that can be expanded from a compact position to at least one expanded position by moving the first end component relative to the second end component. As discussed above, the first end component of the expandable toy building element is movably linked to the second end component of the expandable toy building element by a translation component.

The above-described embodiments of the present invention are meant to be illustrative of preferred embodiments of the present invention and are not intended to limit the scope of the present invention. Various modifications to the above described embodiments consistent with the description as a whole, which would be readily apparent to one skilled in the art, are intended to be within the scope of the present invention. The only limitations to the scope of the present invention are set out in the following appended claims.

What is claimed is:

1. An expandable toy building element being interconnectable with one or more other toy building elements;

the expandable toy building element comprising:

one or more coupling connectors adapted to interconnect the expandable toy building element with the one or more other toy building elements, wherein the one or more coupling connectors are each independently selected from a stud and a recess shaped to releasably couple with the stud; wherein the stud is adapted to releasably couple with a complimentary recess on the one or more other toy building elements and the recess is adapted to releasably couple with a complimentary stud on the one or more other toy building elements;

a first end component, the first end component being hollow and having an open end so as to define a first internal cavity;

a second end component, the second end component being hollow and having an open end so as to define a second internal cavity; and a translation element, the translation element acting to expandably connect the first end component to the second end component;

wherein the expandable toy building element is expandable between a compact position and at least one expanded position, wherein when the expandable toy building element is in the compact position, the open end of the first end component abuts the open end of the second end component such that the translation element is completely enclosed within the first internal cavity and the second internal cavity; and wherein when the expandable toy building element is in the at least one expanded position, the open end of the first end component is separated from the open end of the second end component, so as to at least partially expose the translation element from each of the first internal cavity and second internal cavity; and wherein the expandable toy building element is interconnectable with the one or more other toy building elements when the expandable toy building element is in at least one of the compact position and the at least one expanded position.

2. The expandable toy building element according to claim 1 wherein the translation element comprises a rotatable element adapted to rotatably communicate with an interior surface of the first end component and with an opposite interior surface of the second end component.

3. The expandable toy building element according to claim 2 wherein the translation element further comprises a first toothed rack connected to the interior surface of the first end component and a second toothed rack connected to the opposite interior surface of the second end component; and wherein the rotatable element is a gear adapted to rotatably communicate with each of said first toothed rack and said second toothed rack.

4. The expandable toy building element according to claim 2 wherein the translation element further comprises a first plate having a first receiving slot and a second plate having a second receiving slot and the rotatable element further comprises a first cylindrical portion and a second cylindrical portion, the first cylindrical portion being received in the first receiving slot and the second cylindrical portion being received in the second receiving slot, the first plate being connected to one of the first end component and the second end component and the second plate being connected to the other of the first end component and the second end component.

5. The expandable toy building element according to claim 1 wherein the translation element is a cam having a first cam end and a second cam end, the first cam end being pivotally connected to the first end component and the second cam end being pivotally connected to the second end component.

6. The expandable toy building element according to claim 1 wherein the open end of the first end component comprises a first retaining flange and the open end of the second end component comprises a second retaining flange, and the translation component is a flanged beam, the flanged beam having a first end perimeter flange and a second end perimeter flange, the first retaining flange acting to retain the first end perimeter flange in the first internal cavity and the second retaining flange acting to retain the second end perimeter flange in the second internal cavity.

7. A kit comprising a plurality of interconnectable toy building elements including at least one expandable toy building element according to claim 1.

* * * * *